US006843763B2

(12) United States Patent
Jackson et al.

(10) Patent No.: US 6,843,763 B2
(45) Date of Patent: Jan. 18, 2005

(54) FOLDER CYLINDER WITH SUPPORT PLATE

(75) Inventors: Barry Mark Jackson, York, ME (US); David Clarke Pollock, Somersworth, NH (US)

(73) Assignee: GOSS International Americas, Inc., Dover, NH (US)

( * ) Notice: Subject to any disclaimer, the term of this patent is extended or adjusted under 35 U.S.C. 154(b) by 85 days.

(21) Appl. No.: 10/016,548

(22) Filed: Dec. 13, 2001

(65) Prior Publication Data

US 2003/0110968 A1 Jun. 19, 2003

(51) Int. Cl.[7] ..... B31B 1/10
(52) U.S. Cl. ..... 493/428; 493/432; 493/434
(58) Field of Search ..... 493/428, 424, 493/427, 432, 434, 444

(56) References Cited

U.S. PATENT DOCUMENTS

| | | | | | |
|---|---|---|---|---|---|
| 3,758,102 | A | * | 9/1973 | Munn et al. | 493/342 |
| 4,391,596 | A | * | 7/1983 | Fischer | 493/425 |
| 4,822,328 | A | * | 4/1989 | Bertolini et al. | 493/432 |
| 5,122,109 | A | | 6/1992 | Kubota et al. | 493/427 |
| 5,429,578 | A | | 7/1995 | Calbrix et al. | 493/359 |
| 5,707,330 | A | * | 1/1998 | Kiamco et al. | 493/357 |
| 6,165,118 | A | * | 12/2000 | Eckert | 493/428 |
| 6,250,622 | B1 | * | 6/2001 | Fowler et al. | 493/434 |
| 6,367,792 | B1 | * | 4/2002 | Chagnon | 270/5.02 |

* cited by examiner

*Primary Examiner*—Rinaldi I. Rada
*Assistant Examiner*—Sameh H. Tawfik
(74) *Attorney, Agent, or Firm*—Davidson, Davidson & Kappel, LLC

(57) ABSTRACT

A folding cylinder includes a plurality of gripping devices supported on a first rotatable support with a first gripping device for holding a signature on the cylinder. A plurality of tucking devices are supported on a second rotatable support, the tucking devices including a first tucking device and a second tucking device. The first gripping device is located circumferentially between the first tucking device and second tucking device and a cover fixed to the second rotatable support extends circumferentially over the first gripping device between the first tucking device and the second tucking device. The cover has at least one aperture, with the first gripping device capable of extending through the at least one aperture. With the folding cylinder of the invention gaps between the tucking and gripping spiders can be eliminated.

17 Claims, 4 Drawing Sheets

FOLDER CYLINDER WITH SUPPORT PLATE

BACKGROUND OF THE INVENTION

The present invention relates generally to printing presses and more particularly to a folder of a printing press.

Web printing press print a continuous web of material, such as paper. In a folder of the web printing press, the continuous web then is cut into signatures in a cutting unit and folded.

U.S. Pat. No. 5,429,578 describes a jaw folder receiving a web of material. A cutting cylinder, transfer cylinder and jaw cylinder are provided. The web is cut by the transfer cylinder where the lead edge of the signature is secured by pins. The signature is thus held on the transfer cylinder until tucking blades on the transfer cylinder tuck the signatures into jaws of the jaw cylinder. Thus a cross-fold on the signatures is created along a fold line perpendicular to the travel direction of the signatures. The signatures are then held by the jaws at the fold line until the signatures are to be released. In order to change the position of the fold with respect to the lead edge, the position of the tucking blade with respect to the pins is changed.

FIG. 1 shows details of a known transfer cylinder for a gripper folder, which is type of jaw folder having grippers instead of pins. Tucking blades 12 are supported on a spider 12 geared to a drive shaft. Grippers 20 for lead edges of the signatures 5 are supported on a spider 14, which is also supported on the drive shaft and which normally rotates with spider 12. However, spider 14 is rotatable with respect to spider 12, so that the fold location 15 can be changed.

The signature 5 is supported by cantilevered support segments 18 and 19 attached to spider 12 and supports 21 attached to spider 14. However, in order to provide for relative adjustment of spider 12 with respect to spider 14, gaps 8 and 9 are provided between the cantilevered segments. These gaps 8, 9 have respective clearances d, e which define the amount of relative adjustment possible between the spiders 12, 14.

If large cross-fold adjustment is desired, the gaps in the transfer cylinder must be rather large, which can lead to a lack of support for signatures that in turn can lead to defects such as creasing, edge-tearing or dog-earring. The cantilevered support segments also may be prone to damage from jam forces, which can cause them to bend or break off.

Particularly in the field of newspaper presses, it has been known to provide rotary blade folders, also known as drum folders, that tuck a thick newspaper signature into two nip rollers. U.S. Pat. No. 5,122,109 discloses such a rotary blade folder. The rotary blade passes through bands at the outer surface of the cylinder. Pins for the lead edge of the signature pass through an axially extending gap of the cylinder. In newspaper rotary blade folders of this type it is desirable to adjust the effective radius of the bands to accommodate different signature thicknesses, and thus the bands are located at the tucking blades.

Commonly-assigned U.S. Ser. No. 09/571,606 (which is not necessarily prior art to the present invention) describes a rotary blade folder with an expansion plate with apertures that permit the rotary blades to pass therethrough, and permits adjustment of the effective diameter of the cylinder. The pins remain exposed. The newspaper rotary blade folders do not interact with a jaw cylinder.

Also, in rotary blade or drum folders, the tucking blades typically are supported on an interior cylinder with a planetary gear and then pass through bands, so that the gap problem mentioned with respect to jaw folders often does not exist.

BRIEF SUMMARY OF THE INVENTION

An object of the present invention is to provide a folding cylinder with improved support for signatures. An additional or alternative object of the present invention is to provide a jaw folder with improved support for signatures.

The present invention provides a folding cylinder comprising a plurality of gripping devices for a lead edge of a signature, the gripping devices being supported on a first rotatable support and including a first gripping device. A plurality of tucking devices are supported on a second rotatable support, the tucking devices including a first tucking device and a second tucking device, the first gripping device being located circumferentially between the first tucking device and second tucking device. A cover is fixed to the second rotatable support and extends circumferentially over the first gripping device between the first tucking device and the second tucking device, the cover having at least one aperture, with the first gripping device capable of extending through the at least one aperture.

By having a cover extend over the gripping devices between the first tucking device and the second tucking device, gaps, and the resultant defects such as dog-earring and creasing, can be eliminated.

Preferably, the at least one aperture includes a plurality of apertures spaced axially next to each other, and the first gripping device includes a plurality of axially spaced grippers. Alternately, the first gripping device may include a plurality of axially spaced impaling pins. "Gripping device" as defined herein is any device for holding the edge of a signature on a cylinder and includes both grippers and pins.

Preferably, the first and second support are rotatable with respect to each other and have a common axis of rotation.

The second support preferably is a spider having a first spider arm supporting the first tucking device and a second spider arm supporting the second tucking device, the cover being fixed at one end to the first spider arm and at another end to the second spider arm.

Additional covers having apertures are preferably provided along the entire circumferential extent of the cylinder.

The present invention also provides a jaw folder comprising a cutting cylinder for cutting a signature from a web and a transfer cylinder including a plurality of gripping devices for holding a lead edge of the signature. The gripping devices are supported on a first rotatable support and include a first gripping device. The transfer cylinder includes a plurality of tucking devices supported on a second rotatable support, the tucking devices including a first tucking device and a second tucking device, the first gripping device being located circumferentially between the first tucking device and second tucking device. The transfer cylinder also includes a cover fixed to the second rotatable support and extending circumferentially over the first gripping device between the first tucking device and the second tucking device, the cover having at least one aperture, the first gripping device capable of extending through the at least one aperture. A jaw cylinder receives the signature at a fold created by the first tucking device.

The jaw folder of the present invention can reduce folding defects.

The present invention also provides a method of folding a signature comprising the steps of:

moving a gripping device through an aperture of a cover on a folding cylinder, the cover extending over the gripping device when the gripping device is retracted;

gripping the signature and supporting signature on the cover as the folding cylinder rotates; and tucking the signature using a folding blade.

Preferably, the signature is tucked into the jaw of a jaw cylinder.

Figure 1:
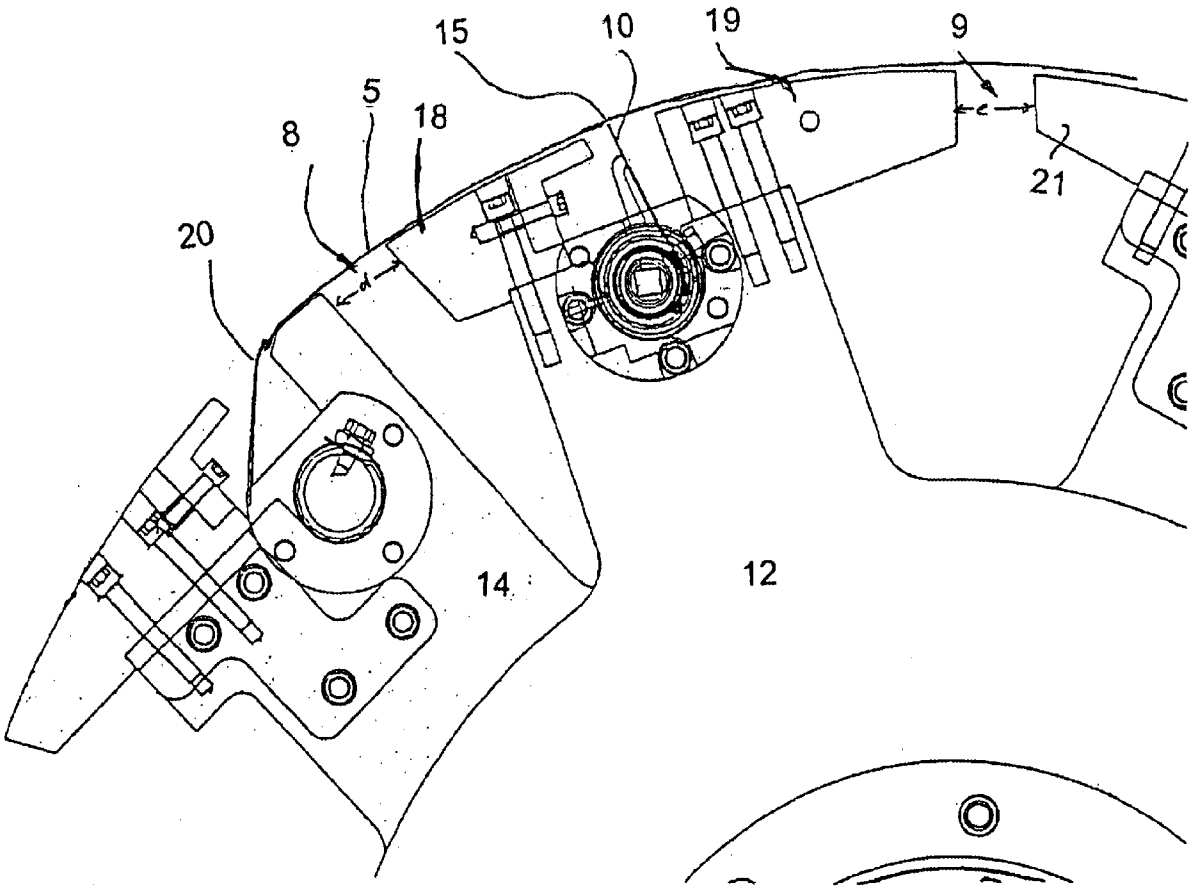
Fig. 1 (Prior Art)
FIG. 1 shows a prior art transfer cylinder for a jaw folder.
Figure 2:
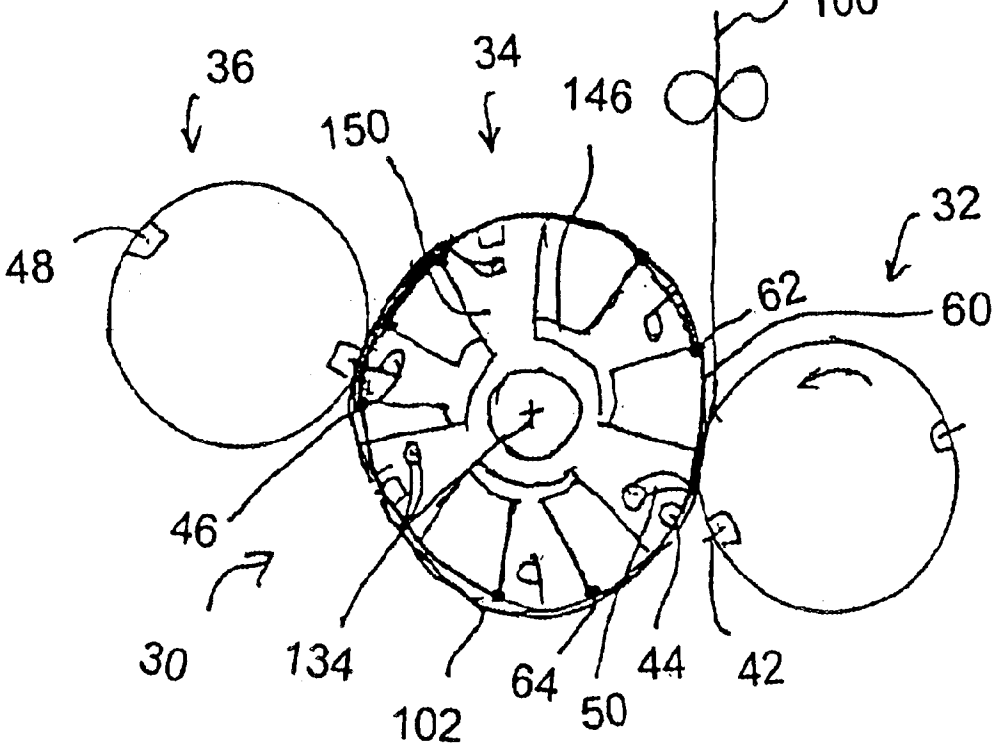
Figure 3:
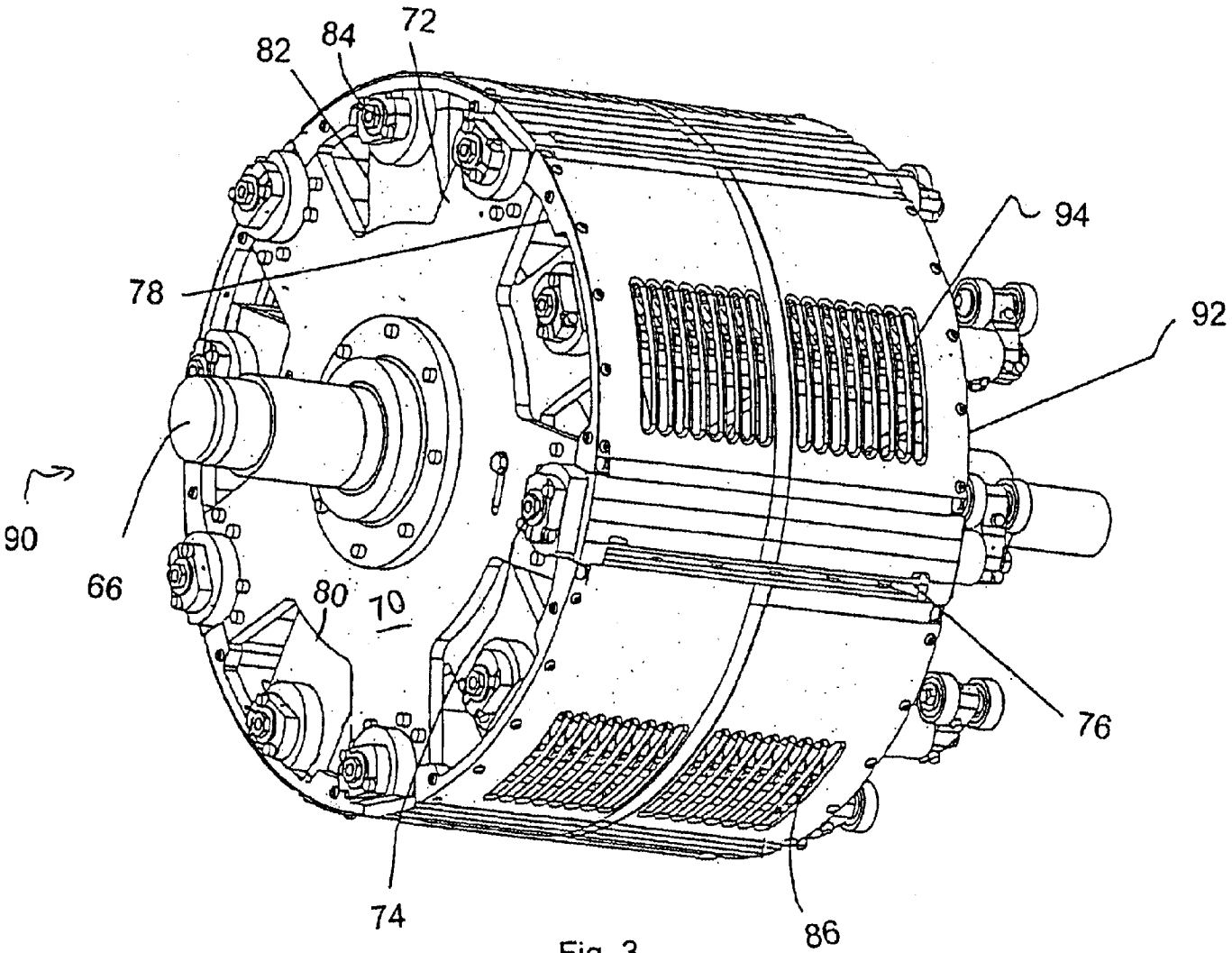
Figure 4:
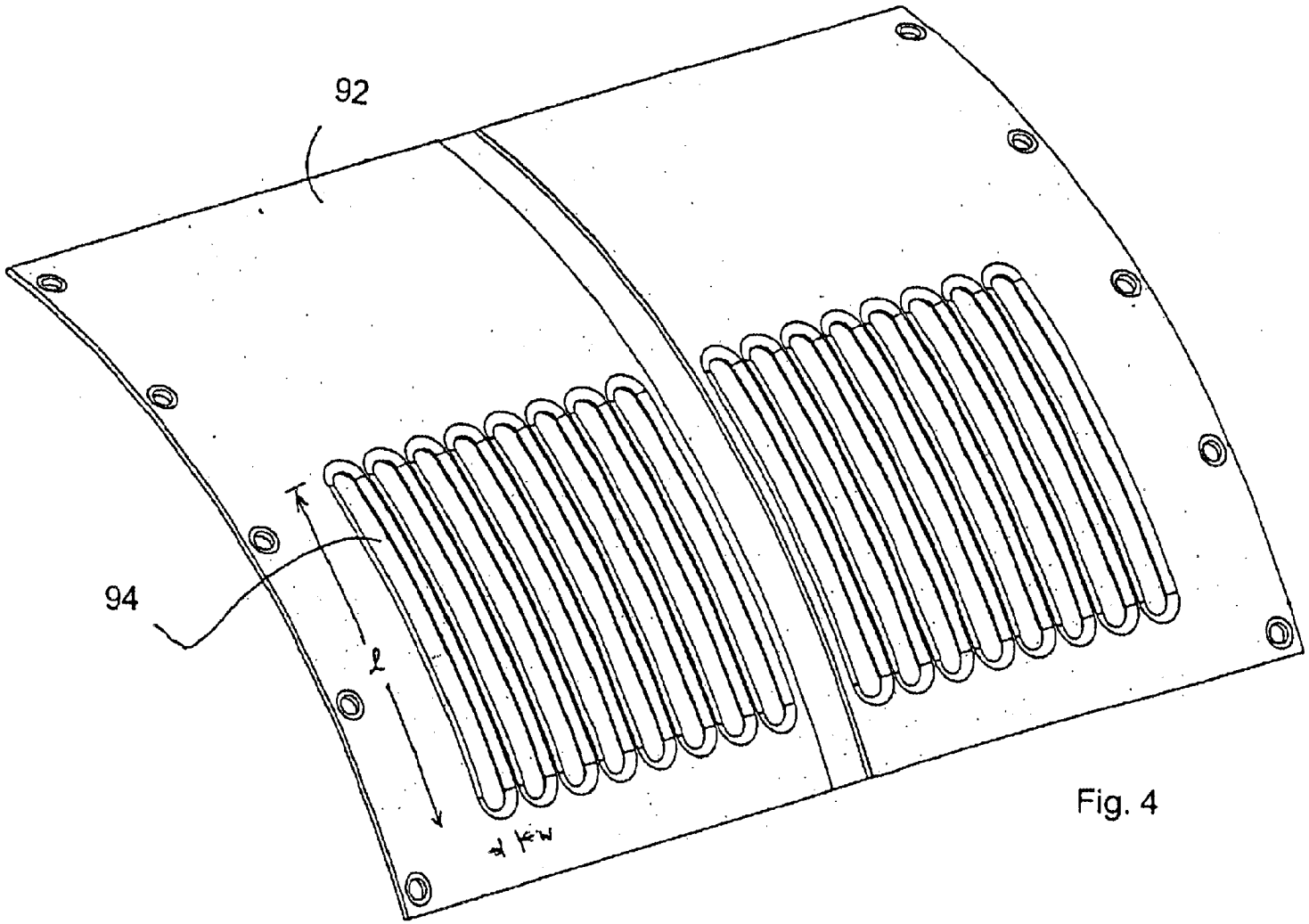

Embodiments of the present invention is described below by reference to the following FIGS. 2 to 4, in which:

FIG. 2 shows a schematic side view of a jaw folder of the present invention, with three tucking blade sets and three sets of impaling pins;

FIG. 3 shows a preferred embodiment of a folding cylinder according to the present invention, and FIG. 4 shows a the cover of the folding cylinder of FIG. 3 in more detail.

DETAILED DESCRIPTION

FIG. 2 shows a schematic side view of a jaw folder 30 having a cutting cylinder 32, a transfer cylinder 34 and a jaw cylinder 36. Web 100 is cut by the cutting cylinder 32, which has knives 42 acting against anvils 44 on the transfer cylinder 34, so that signatures 102 are formed. Pins 50 hold the lead edge of signatures 102 in place. Signatures 102 are tucking into jaws 48 of jaw cylinder 36 by tuckers 46 of transfer cylinder 34. Transfer cylinder 34 has a central axis 134. Tucker spider 146 supports tuckers 46 and gripper spider 150 supports pins 50 and anvils 44.

Covers 60 extend over the pins 50, and are fastened by a fastener 62, for example screws, at one end to one arm of tucker spider 146 and at the other end by a fastener 64. The covers 60 have apertures through which the pins 50 can extend. While covers 60 are fixed to spider 146, spider 150 can rotate with respect to covers 60, and thus the apertures preferably are elongated in the circumferential direction so that the pins 50 can extend through the apertures even as the fold location changes.

FIG. 3 provides more details of a preferred embodiment of a transfer cylinder 90 with five circumferentially-spaced sets of tucking and gripping devices. A central axle 66 supports a tucker spider 70 and a gripper spider 80. Tucker spider 70 has arms 72 supporting tucking devices 74. Tucking devices 74 include at least one tucking blade 76 that can extend beyond the circumference of the cylinder 90 to tuck a signature.

Extending between two arms 72 of spider 70 are two curved supports 78 (one of which is shown in FIG. 3, the other one being on the other axial side of cylinder 90) that have a radius of curvature substantially the same as the radius of the cylinder 90. The curved supports 78 are fastened, for example by screws or bolts, at each end to one of arms 72. A cover 92 is fastened by screws or bolts to supports 78, so that cover 92 defines a circumferentially-extending surface of cylinder 90.

Each cover 92 has a plurality of axially-spaced apertures or holes 94, that preferably are elongated in the circumferential direction, i.e. that their axial width is smaller than their circumferential length.

Gripper spider 80 has arms 82 supporting gripping devices 84. Each gripping device has a plurality of axially-spaced grippers 86 which can extend through the apertures 94 to hold a lead edge of a signature.

The distance between the gripping device 84 and tucking device 74 determines the cross-fold location for the signature. This distance can be altered by changing the phase angle between the gripper spider 80 and the tucker spider 70. The grippers 86 thus are rotated with respect to the tucking blade 76. Since the apertures 94 are elongated in the circumferential direction, the grippers 86 have a wide range of available motion with respect to the tucking blades 76 so as to set the fold location.

FIG. 4 shows cover 92 in greater detail, with cover 92 having a plurality of axially-extending apertures 94. Apertures 94 have a circumferential length 1 which preferably is greater than, and most preferably more than 4 times greater than, a width w.

Cover 60 of the FIG. 2 embodiment may be similar to cover 80.

List of Elements

30 jaw folder
32 cutting cylinder
34 transfer cylinder
36 jaw cylinder
42 knives
44 anvils
46 tuckers
48 jaws
50 pins
60 covers
62 fastener
64 fastener
66 central axle
70 tucker spider
72 tucker spider arms
74 tucking devices
76 tucking blade
78 curved supports
80 gripper spider
82 gripper spider arms
84 gripping devices
86 grippers
90 transfer cylinder
100 web
102 signatures
134 central axis
146 tucker spider
150 gripper spider
w aperture width
1 aperture length

What is claimed is:

1. A folding cylinder comprising:

a plurality of gripping devices supported on a first rotatable support and including a first gripping device for holding a signature on the cylinder;

a plurality of tucking devices supported on a second rotatable support, the tucking devices including a first tucking device and a second tucking device, the first gripping device being located circumferentially between the first tucking device and second tucking device, the first and second rotatable supports being rotatable with respect to each other so as to set a fold position of the signature; and a cover fixed to the second rotatable support and extending circumferentially over the first gripping device between the first tucking device and the second tucking device, the cover having at least one aperture, the first gripping device extending through the at least one aperture.

2. The cylinder as recited in claim 1 wherein the at least one aperture includes a plurality of apertures spaced axially next to each other.

3. The cylinder as recited in claim 2 wherein the first gripping device includes a plurality of axially spaced grippers.

4. The cylinder as recited in claim 2 wherein the first gripping device includes a plurality of axially spaced impaling pins.

5. The cylinder as recited in claim 1 wherein the second support is a spider having a first spider arm supporting the first tucking device and a second spider arm supporting the second tucking device, the cover being fixed at one end to the first spider arm and at another end to the second spider arm.

6. The cylinder as recited in claim 1 further including a second cover covering a second of the plurality of gripping devices.

7. The cylinder as recited in claim 1 wherein the first and second rotatable supports rotate about a same axis.

8. The cylinder as recited in claim 1 wherein the first rotatable support is a tucker spider and the second rotatable support a gripper spider.

9. A jaw folder comprising a folding cylinder as recited in claim 1.

10. A folding cylinder comprising:

a plurality of gripping devices supported on a first rotatable support and including a first gripping device for holding a signature on the cylinder;

a plurality of tucking devices supported on a second rotatable support, the tucking devices including a first tucking device and a second tucking device, the first gripping device being located circumferentially between the first tucking device and second tucking device, the first and second rotatable supports being rotatable about a same central axis; and a cover fixed to the second rotatable support and extending circumferentially over the first gripping device between the first tucking device and the second tucking device, the cover having at least one aperture, the first gripping device extending through the at least one aperture.

11. The cylinder as recited in claim 10 wherein the at least one aperture includes a plurality of apertures spaced axially next to each other.

12. The cylinder as recited in claim 11 wherein the first gripping device includes a plurality of axially spaced grippers.

13. The cylinder as recited in claim 11 wherein the first gripping device includes a plurality of axially spaced impaling pins.

14. The cylinder as recited in claim 10 wherein the first and second rotatable supports are rotatable with respect to each other so as to set a fold position of the signature.

15. The cylinder as recited in claim 10 wherein the second support is a spider having a first spider arm supporting the first tucking device and a second spider arm supporting the second tucking device, the cover being fixed at one end to the first spider arm and at another end to the second spider arm.

16. The cylinder as recited in claim 10 further including a second cover covering a second of the plurality of gripping devices.

17. The cylinder as recited in claim 10 wherein the first rotatable support is a tucker spider and the second rotatable support a gripper spider.

* * * * *